US008511668B2

(12) United States Patent
Ishikawa et al.

(10) Patent No.: US 8,511,668 B2
(45) Date of Patent: Aug. 20, 2013

(54) SHEET FEEDING DEVICE AND IMAGE FORMING APPARATUS INCORPORATING SAME

(75) Inventors: Yoshikuni Ishikawa, Tokyo (JP); Yu Wakabayashi, Kanagawa-ken (JP); Toshiaki Takahashi, Tokyo (JP); Manabu Nonaka, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 138 days.

(21) Appl. No.: 12/926,487

(22) Filed: Nov. 22, 2010

(65) Prior Publication Data

US 2011/0121506 A1 May 26, 2011

(30) Foreign Application Priority Data

Nov. 25, 2009 (JP) ..... 2009-267510
Jan. 29, 2010 (JP) ..... 2010-018706
May 31, 2010 (JP) ..... 2010-124595

(51) Int. Cl.
*B65H 3/18* (2006.01)

(52) U.S. Cl.
USPC ..... 271/18.1; 271/901

(58) Field of Classification Search
USPC ..... 271/18.1, 901
See application file for complete search history.

(56) References Cited

U.S. PATENT DOCUMENTS 5,503,388 A * 4/1996 Guenther et al. ..... 271/207
2008/0054548 A1 * 3/2008 Kim et al. ..... 271/18.1

FOREIGN PATENT DOCUMENTS

JP 05270677 A * 10/1993
JP 09-067033 3/1997
JP 3159727 2/2001
JP 2009-023813 2/2009
JP 2009023813 A * 2/2009

OTHER PUBLICATIONS

Abstract of JP 04-251041 published Sep. 7, 1992.

* cited by examiner

*Primary Examiner* — Gerald McClain
(74) *Attorney, Agent, or Firm* — Harness, Dickey & Pierce P.L.C.

(57) ABSTRACT

A sheet feeding device includes a sheet carrying unit and an attraction separation and conveyance device. The sheet carrying unit is configured to carry thereon a sheet stack. The attraction separation and conveyance device is configured to electrostatically attract the uppermost sheet of the sheet stack and separate and convey the uppermost sheet from the sheet stack, and is placed between the upstream end and the central position in a sheet conveying direction of the sheet stack located at a sheet carrying position and having a minimum sheet size compatible with the sheet feeding device.

20 Claims, 7 Drawing Sheets

SHEET FEEDING DEVICE AND IMAGE FORMING APPARATUS INCORPORATING SAME

CROSS-REFERENCE TO RELATED APPLICATIONS

The present invention claims priority pursuant to 35 U.S.C. §119 from Japanese Patent Application No. 2009-267510, filed on Nov. 25, 2009 in the Japan Patent Office, Japanese Patent Application No. 2010-018706, filed on Jan. 29, 2010 in the Japan Patent Office, and Japanese Patent Application No. 2010-124595, filed on May 31, 2010 in the Japan Patent Office, the contents and disclosures of which are hereby incorporated by reference herein in their entirety.

BACKGROUND OF THE INVENTION

1. Field of the Invention

The present invention relates to a sheet feeding device that separates and conveys the uppermost sheet from a sheet stack using electrostatic attraction, and an image forming apparatus including the sheet feeding device.

2. Discussion of the Related Art

Background sheet feeding devices that separate and convey the uppermost sheet from a sheet stack include those that separate and feed stacked sheets, such as documents and recording sheets, by using frictional force, those that separate and feed sheets by air suction.

In background sheet feeding devices using the frictional separation method, which separates sheets by using frictional force, a material such as rubber is used to form feeding rollers. Therefore, a change over time in the condition of the feeding rollers due to abrasion or the like results in a change in the frictional force exerted by the feeding rollers, that is, consequent deterioration of feeding performance. Further, when separating and feeding sheets having unequal coefficients of friction due to variations from sheet to sheet, or when separating and feeding sheets having inherently different coefficients of friction in the same feeding operation, the frictional force acting between the feeding rollers and the sheets changes. In some cases, therefore, the separation of sheets fails, or multiple feeding occurs in which a plurality of sheets are fed together. Further, the feeding rollers need to be pressed against the sheets in order to function, and in some cases the sheets are dirtied or damaged as a result.

By contrast, background sheet feeding devices using the air suction method, which separates sheets by air suction, employ a non-frictional separation method not relying on the frictional force acting between the feeding rollers and the sheets, and thus the above-described problems do not arise. However, the sheet feeding device requires a blower and a duct for the air suction. As a result, the sheet feeding device is increased in size, and the sound accompanying the air suction constitutes noise. Therefore, this type of sheet feeding device is not suitable for use in an office environment.

In view of the above, as one non-frictional separation method, an electrostatic attraction separation method has been proposed which generates an electric field in a dielectric belt and brings the dielectric belt into contact with a sheet to attract and separate the sheet from other sheets.

Specifically, a background sheet feeding device according to the electrostatic attraction separation method first applies an alternating charge to a circular dielectric belt wound around a plurality of rollers, and swings or translates the dielectric belt relative to a sheet stack such that the dielectric belt approaches or contacts the sheet stack. Then, the sheet feeding device causes the dielectric belt to stand by for a predetermined time to attract the uppermost sheet of the sheet stack, and thereafter moves the dielectric belt away from the sheet stack, thereby, separating the uppermost sheet and conveying it from the sheet stack.

In another approach, an electrostatic attraction member for electrostatically attracting the uppermost sheet is provided upstream in the sheet conveying direction of the placement location of a rotary feeding member. With this configuration, the sheet feeding device is capable of reliably feeding sheets one by one and reducing the device size and cost using a simple configuration.

The sheet feeding device using the electrostatic attraction separation method is advantageous in preventing not only the abrasion of the feeding rollers and the damage to the sheets, which occur in the frictional separation method, but also the increase in device size and the noise generation, which occur in the air suction method.

When separating and feeding relatively thick sheets or sheets difficult to attract due to the electrical characteristics thereof, however, sheet feeding devices using the electrostatic attraction separation method need to extend the predetermined time for causing the dielectric belt to stand by to electrostatically attract the uppermost sheet. As a result, the productivity suffers.

SUMMARY OF THE INVENTION

This patent application describes a novel sheet feeding device. In one example, a sheet feeding device includes a sheet carrying unit and an attraction separation and conveyance device. The sheet carrying unit is configured to carry thereon a sheet stack. The attraction separation and conveyance device is configured to electrostatically attract an uppermost sheet of the sheet stack and separate and convey the uppermost sheet from the sheet stack, disposed between an upstream end and a central position in a sheet conveying direction of the sheet stack in a state in which the sheet stack is located at a sheet carrying position and having a minimum sheet size compatible with the sheet feeding device.

The above-described sheet feeding device may further includes a lifting and lowering device configured to lift and lower the sheet stack carried on the sheet carrying unit. The sheet feeding device may cause the lifting and lowering device to lift the sheet stack to a lift position at which the uppermost sheet contacts with the attraction separation and conveyance device, cause the attraction separation and conveyance device to stand by for a predetermined time to attract the uppermost sheet, and cause the attraction separation and conveyance device to start conveying the uppermost sheet with the sheet stack kept at the lift position after the predetermined time elapses.

The attraction separation and conveyance device may be centrally disposed in a direction perpendicular to the sheet conveying direction with respect to the sheet carrying unit.

The attraction separation and conveyance device may include a plurality of rollers driven by a drive device and an endless dielectric belt stretched over the plurality of rollers. A further upstream roller of the plurality of rollers in the sheet conveying direction may drive the attraction separation and conveyance device.

The above-described sheet feeding device may further include a sheet conveying device configured to include a roller pair for nipping and further conveying the uppermost sheet separated and conveyed by the attraction separation and conveyance device.

The attraction separation and conveyance device and the sheet conveying device may be arranged such that a tangent line of a nip portion formed by the attraction separation and conveyance device and the sheet stack and a tangent line of a nip portion formed by the roller pair of the sheet conveying device are substantially the same.

The above-described sheet feeding device has a relation of X1>X2, where "X1" represents a distance between the upstream end in the sheet conveying direction of the sheet stack carried on the sheet carrying unit and a nip portion at the downstream end in the sheet conveying direction of the attraction separation, and conveyance device, and "X2" represents a distance between the downstream end in the sheet conveying direction of the sheet stack carried on the sheet carrying unit and a nip portion of the roller pair of the sheet conveying device.

The above-described sheet feeding device may further include a planar guide member disposed between the attraction separation and conveyance device and the sheet conveying device substantially parallel to a tangent line of a nip portion formed by the attraction separation and conveyance device and the sheet stack and a tangent line of a nip portion formed by the roller pair of the sheet conveying device, and configured to guide the uppermost sheet from the attraction separation and conveyance device to the sheet conveying device.

The conveying force of the sheet conveying device may be set to be greater than the conveying force of the attraction separation and conveyance device.

This patent specification further describes a novel image forming apparatus. In one example, an image forming apparatus includes the above-described sheet feeding device, an image forming unit configured to form an image on a sheet fed from the sheet feeding device, and a conveying device configured to convey the sheet to the image forming unit.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein:

FIGS. 7A and 78 are a top view and a side view of the sheet feeding device according to the another embodiment of the present invention;

DETAILED DESCRIPTION OF PREFERRED EMBODIMENTS

Figure 1:
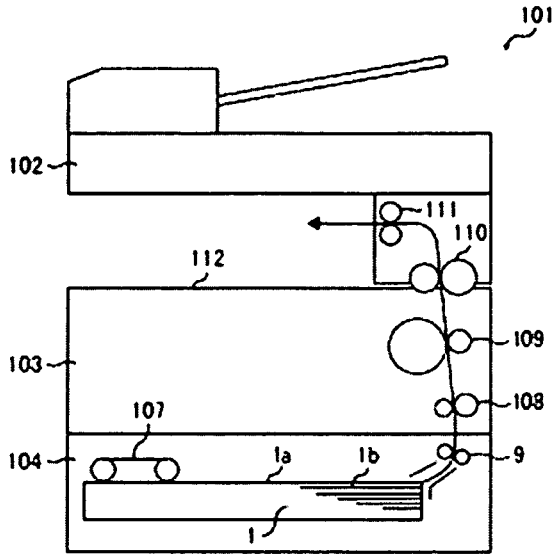
FIG. 1 is a schematic cross-sectional view of an image forming apparatus including a sheet feeding device according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, embodiments of the present invention will be described.

The configuration of an embodiment of the present invention will be first described. As illustrated in FIG. 1, an image forming apparatus 101 is configured as an electrophotographic digital copier, and includes a document reading unit 102, an image forming unit 103, and a sheet feeding device 104. The document reading unit 102 reads the image of a document. The sheet feeding device 104, which includes a separation unit 107 and a sheet feeding roller pair 9, feeds a recording sheet (i.e., recording medium, hereinafter simply referred to as sheet) 1*a* from a sheet stack 1, which includes the sheet 1*a*, a sheet 1*b* and other sheets, to the image forming unit 103. The image forming unit 103 forms the image read by the document reading unit 102 on the sheet 1*a* fed from the sheet feeding device 104. In the image forming apparatus 101 according to the present embodiment, the image forming unit 103 and the sheet feeding device 104 can be separated from each other.

The sheet 1*a* fed by the sheet feeding device 104 is conveyed to the image forming unit 103 by a conveying roller pair 108 serving as a conveying device. Then, a toner image formed by the image forming unit 103 is transferred onto the sheet 1*a* by a transfer device 109 and thermally transferred and fixed to the sheet 1*a* by a fixing device 110. Thereafter, the sheet 1*a* is discharged onto a sheet discharging tray 112 by a sheet discharging roller pair 111.

The image forming method employed by the image forming apparatus 101 is not limited to the electrophotographic method. Thus, the image forming apparatus 101 may employ another method, such as the inkjet method, for example. Further, the image forming apparatus 101 is not limited to the copier, and thus may be configured as a facsimile machine, a printer, a multifunctional machine, and so forth.

Figure 2:
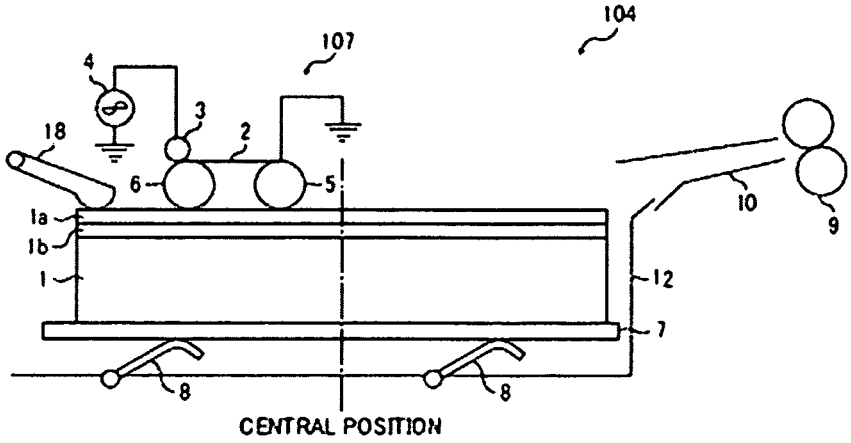
FIG. 2 is a cross-sectional view of the sheet feeding device according to the embodiment of the present invention.
Figure 3:
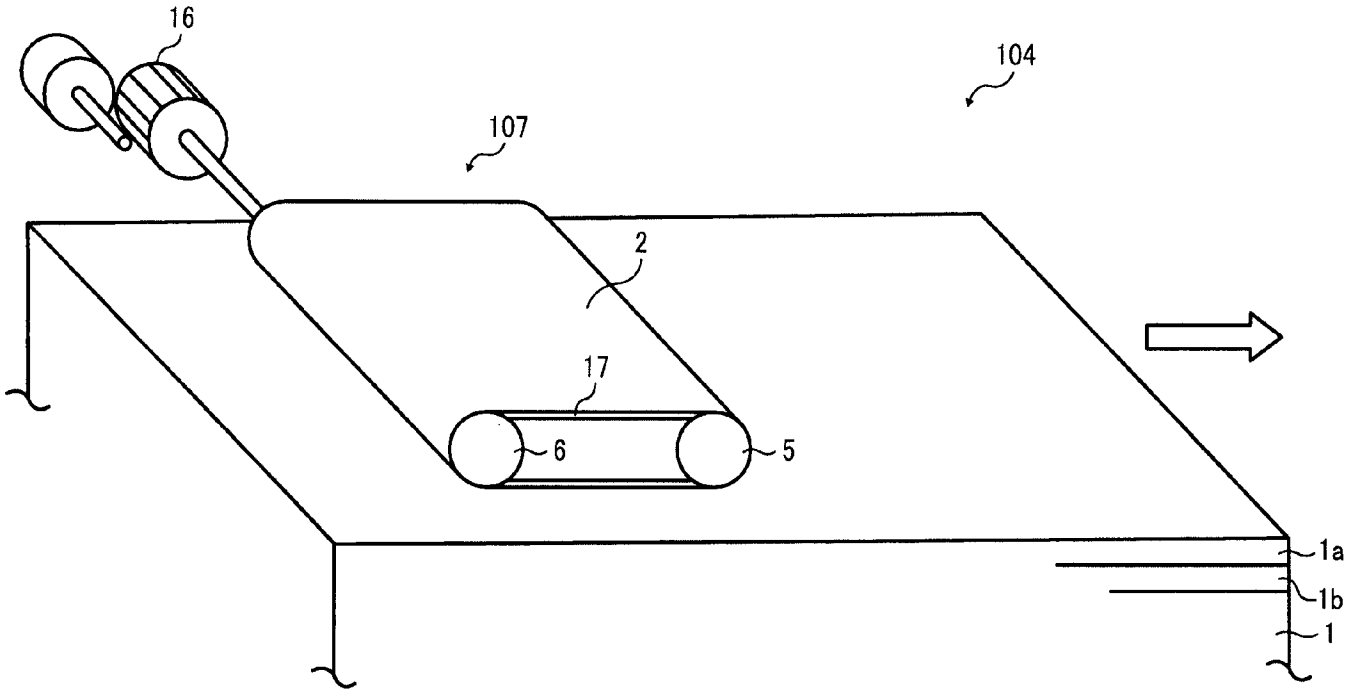
FIG. 3 is a perspective view of the sheet feeding device according to the embodiment of the present invention.

As illustrated in FIGS. 2 and 3, the sheet feeding device 104 includes a sheet feeding tray 12 for storing the sheet stack 1, a bottom plate 7 serving as a sheet carrying unit and provided under a bottom portion of the sheet feeding tray 12 to carry thereon the sheet stack 1, bottom plate lifting arms 8 for lifting and lowering the bottom plate 7, and the separation unit 107 which contacts the upper surface of the sheet stack 1, electrostatically attracts and separates the uppermost sheet 1*a* from the sheet stack 1, and conveys the separated sheet 1*a*.

The separation unit 107 includes a downstream roller 5, an upstream roller 6, and a circular belt 2 formed by a dielectric material and wound around the downstream roller 5 and the upstream roller 6. The attraction, separation, and conveyance of the sheet 1*a* by the separation unit 107 are mainly performed by the belt 2. Practically, therefore, the belt 2 forms the substance of the separation unit 107. Thus, detailed description of the belt 2 will be made below to describe the separation unit 107.

The upstream roller 6 is configured as a drive roller which receives drive force from a not-illustrated drive source. The downstream roller 5 is configured as a driven roller which is driven to rotate in accordance with the rotation of the upstream roller 6 via the belt 2. The drive force from the not-illustrated drive source is transmitted to the upstream roller 6 via an electromagnetic clutch 16. The electromagnetic clutch 16 is activated in accordance with a sheet feeding signal to intermittently drive the upstream roller 6.

A surface of the upstream roller 6 is formed by a conductive rubber layer having a resistance value of approximately $10^6$ Ω·cm (ohm centimeters). Meanwhile, a surface of the downstream roller 5 is made of metal. The upstream roller 6 and the downstream roller 5 are electrically grounded. The downstream roller 5 has a relatively small diameter suitable for separating the sheet 1*a* from the belt 2 in accordance with the curvature thereof. That is, the downstream roller 5 is set to have a relatively small diameter to increase the curvature thereof. With this configuration, the sheet 1*a* attracted, separated, and conveyed by the belt 2 is allowed to separate from the downstream roller 5 and enter between a guide plate pair 10 located downstream in the sheet conveying direction.

The downstream roller 5 and the upstream roller 6, which respectively serve as the driven roller and the drive roller, are arranged such that a lower tangent line of the belt 2 formed by the downstream roller 5 and the upstream roller 6 is on a level with the upper surface of the sheet 1*a*.

The belt 2 is formed by a dielectric material having a resistance of at least approximately $10^8$ Ω·cm. The dielectric material forming the belt 2 may include, for example, a film made of polyethylene terephthalate or the like having a thickness of approximately 100 μm (micrometers).

The belt 2 is stretched over the downstream roller 5 and the upstream roller 6, slacking downward to a degree not causing the upstream roller 6 to spin around without rotating the belt 2. With the downward slacking belt 2 brought into contact with the sheet 1*a*, it is possible to secure the area of contact of the belt 2 with the sheet 1*a*, even if the sheet 1*a* is undulated.

In the present embodiment, the belt 2 is stretched over two rollers of the downstream roller 5 and the upstream roller 6. The belt 2, however, may be stretched over a larger number of rollers, and one of the rollers located most upstream in the sheet conveying direction may be configured as a drive roller.

The belt 2 is placed between the upstream end and the central position in the sheet conveying direction of the sheet stack 1 located at a sheet carrying position and having the minimum sheet size compatible with the sheet feeding device 104. For example, if the size of the sheet 1*a* compatible with the sheet feeding device 104 ranges from A5 to A3, the belt 2 is arranged such that the downstream end in the sheet conveying direction of the belt 2, which corresponds to the position of contact of the downstream roller 5 with the sheet 1*a*, is located between the center of the length in the sheet conveying direction of the sheet 1*a* having the minimum sheet size A5 (i.e., 210 mm) and the upstream end of the sheet 1*a*, i.e., between a position apart from the leading end of the sheet 1*a* by 105 mm to a position apart from the leading end by 210 mm.

Further, the belt 2 is placed at the center in a direction perpendicular to the sheet conveying direction. That is, as for the width direction perpendicular to the sheet conveying direction, i.e., the depth direction in FIG. 1, the belt 2 is placed relative to the sheet stack 1 such that the central position of the sheet stack 1 set on the center baseline corresponds to the central position of the belt 2. The width of the belt 2 is set to a length obtained by reducing approximately 20 mm from both sides of the width of the sheet 1*a* having the maximum sheet size compatible with the sheet feeding device 104.

The guide plate pair 10 for guiding the conveyance of the sheet 1*a* and the sheet feeding roller pair 9 for conveying the sheet 1*a* entered between the guide plate pair 10 are provided downstream in the sheet conveying direction of the belt 2.

Inside portions of side edges of the belt 2 are provided with ribs 17. The ribs 17 of the belt 2 engage with respective side surfaces of the downstream roller 5 and the upstream roller 6. With this configuration, the belt 2 is prevented from moving in the width direction thereof and coming off the downstream roller 5 and the upstream roller 6.

On the upstream side in the sheet conveying direction of the separation unit 107, a feeler sensor 18 is provided which detects that the uppermost sheet 1*a* of the sheet stack 1 lifted by the bottom plate lifting arms 8 is located at a sheet feed position at which the sheet 1*a* contacts the belt 2. The feeler sensor 18 is placed at a position corresponding to an end portion in the width direction of the sheet stack 1, and thus does not come into contact with the belt 2 placed on the upstream side in the sheet conveying direction.

At a position at which the belt 2 is wound around the upstream roller 6, a charging roller electrode 3 is provided which contacts the outer circumferential surface of the belt 2 and is driven to rotate in accordance with the rotation of the belt 2. The roller electrode 3 is connected to an alternating-current power supply 4.

At a position upstream of the roller electrode 3 in the rotation direction of the belt 2 and downstream of the position at which the sheet stack 1 and the belt 2 separate from each other, a discharging roller electrode connected to a not-illustrated discharging power supply, which is an alternating power supply, may be provided such that the discharging roller electrode contacts the belt 2 and is driven to rotate in accordance with the rotation of the belt 2. In this case, the charging roller electrode 3 and the discharging roller electrode are controlled such that the attraction force of the belt 2 has been removed by the time the downstream end in the sheet conveying direction of the sheet 1*a* contacts the sheet feeding roller pair 9. The discharging roller electrode is not necessarily required, and thus may be omitted. In the description of the present embodiment, therefore, the sheet feeding device 104 is assumed to include the charging roller electrode 3 but not to include the discharging roller electrode.

Now, the operations of the sheet feeding device 104 will be described.

Figure 4A:
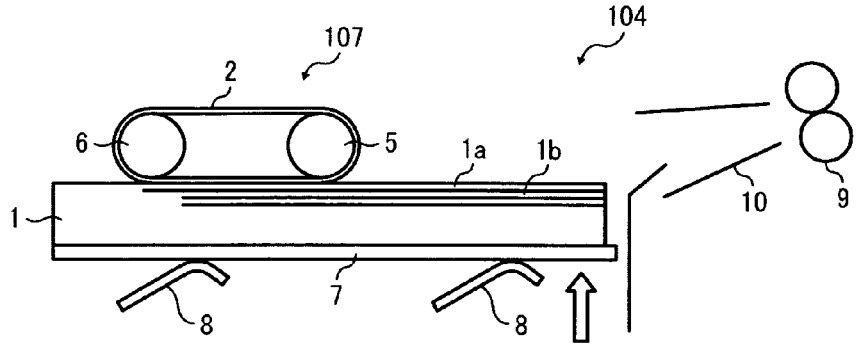
FIGS. 4A, 4B, and 4C are cross-sectional views illustrating operations of the sheet feeding device according to the embodiment of the present invention.

As illustrated in FIG. 4A, upon receipt of a sheet feeding command signal from a not-illustrated control unit, the electromagnetic clutch 16 is turned on to drive and rotate the upstream roller 6. Thereby, the belt 2 starts rotating, and is supplied with an alternating voltage by the power supply 4 via the roller electrode 3. As a result, charge patterns alternating at intervals according to the frequency of the alternating-current power supply and the rotation speed of the belt 2 are formed on the surface of the belt 2. Preferably, the intervals are set to a length of from approximately 4 mm to approximately 16 mm.

After the charging of the belt 2, the bottom plate lifting arms 8 start lifting the lowered bottom plate 7. The bottom plate lifting arms 8 stop lifting the bottom plate 7 when the feeler sensor 18 detects that the uppermost sheet 1*a* of the sheet stack 1 has reached a lift position at which the sheet 1*a* contacts the belt 2 (i.e., the sheet feed position). In the lifting of the bottom plate 7, the lift amount of the bottom plate 7 may be determined on the basis of the calculation of the difference in height between the lower surface of the belt 2 and the position of the upper surface of the sheet 1*a* prior to the lifting of the bottom plate 7, which has previously been detected by the feeler sensor 18.

Figure 4B:
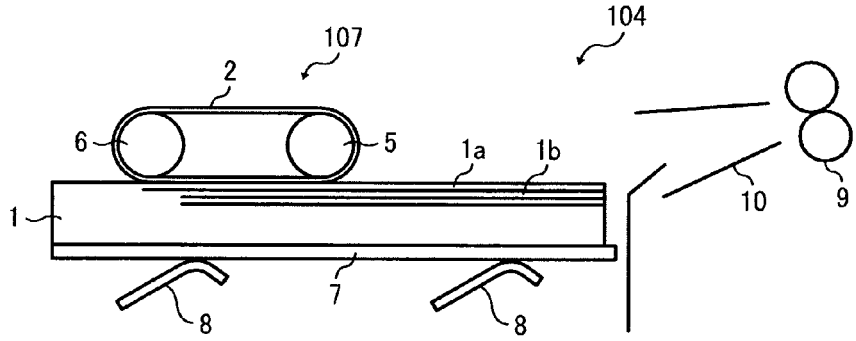

Then, as illustrated in FIG. 4B, in the state in which the belt 2 and the uppermost sheet 1*a* of the sheet stack 1 are in contact with each other, the belt 2 stands by for a predetermined time, which has been preset for each of each type of sheet. Thereby, the Maxwell stress acts on the uppermost sheet 1*a*, which is a dielectric material, due to a non-uniform electric field generated by the charge patterns formed on the surface of the belt 2. As a result, only the uppermost sheet 1*a* is attracted and held by the belt 2.

Immediately after the contact between the belt 2 and the uppermost sheet 1*a*, the electric field generated by the non-uniform charging of the belt 2 acts on a plurality of sheets of the sheet stack 1 on the basis of the action of the Maxwell stress, and thus a force of attraction for attracting the plurality of sheets is generated. After the lapse of the predetermined time, however, free electrons in the uppermost sheet 1*a* gather toward the belt 2 to neutralize the electric field of the belt 2. Therefore, the attraction force of the belt 2 acts only on the uppermost sheet 1*a*.

Figure 4C:
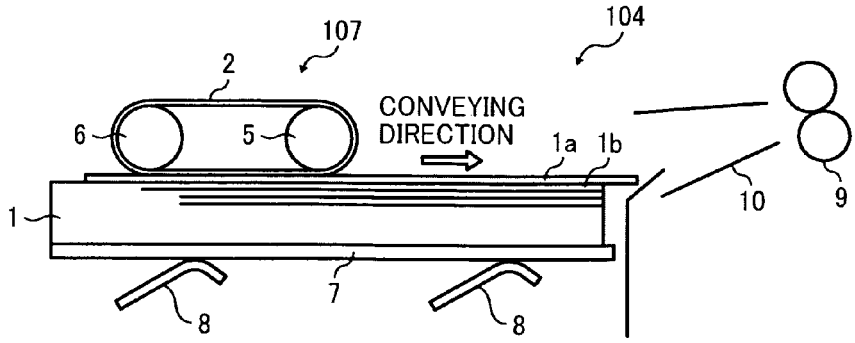

Then, as illustrated in FIG. 4C, the belt 2 rotates and starts conveying the sheet 1*a* in the state in which the sheet stack 1 is kept at the lift position. Then, at a position corresponding to the downstream roller 5, the sheet 1*a* separates from the belt 2 due to the curvature of the downstream roller 5. The conveyance of the sheet 1*a* based on the rotation of the belt 2 does not use the frictional force acting between the belt 2 and the sheet 1*a*, but uses the electrostatic attraction force instead. It is therefore possible to minimize the contact pressure between the belt 2 and the sheet 1*a*. Accordingly, the uppermost sheet 1*a* and the second uppermost sheet 1*b* are prevented from being conveyed together in an overlapped matter due to the frictional force acting therebetween. That is, multiple feeding is prevented. Moreover, the sheet feeding roller pair 9 and the belt 2 are set to have the same linear velocity. Therefore, if the sheet feeding roller pair 9 is intermittently driven to adjust the timing, the belt 2 is also controlled to be intermittently driven.

Figure 5A:
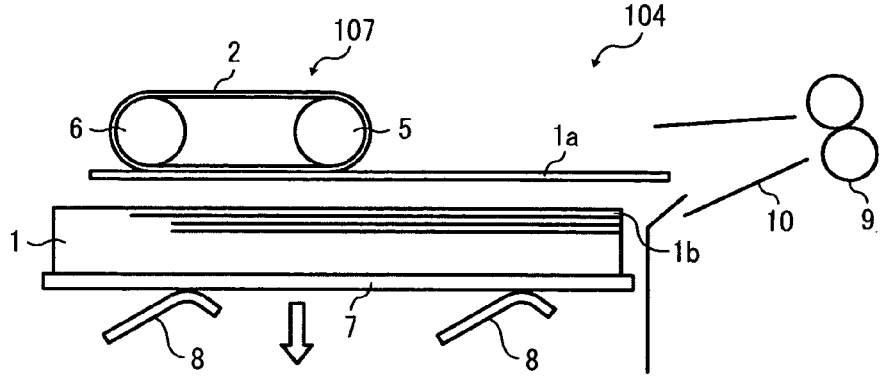
FIGS. 5A and 5B are cross-sectional views illustrating operations subsequent to the operations illustrated in FIGS. 4A, 4B, and 4C.

Then, as illustrated in FIG. 5A, before the upstream end in the sheet conveying direction of the sheet 1*a* reaches the upstream roller 6, the bottom plate 7 is lowered for a predetermined time to separate the sheet stack 1 from the belt 2. Thereby, the second uppermost sheet 1*b* of the sheet stack 1 is prevented from being attracted by the belt 2 during the conveyance of the uppermost sheet 1*a*. Further, in the state in which the belt 2 and the sheet stack 1 are separated from each other, the belt 2 is charged in preparation for the attraction of the next sheet 1*b*.

Figure 5B:
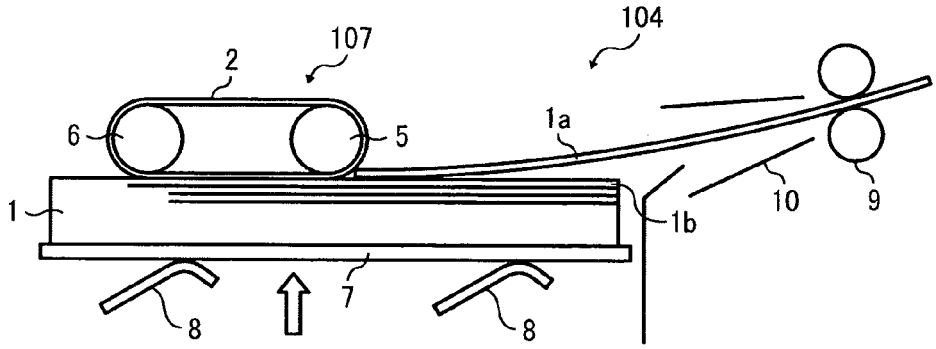

Then, as illustrated in FIG. 5B, the bottom plate 7 is lifted after the upstream end in the sheet conveying direction of the sheet 1*a* has passed the downstream roller 5. The sheet stack 1 having the sheet 1*b* on the top thereof is then brought into contact with the belt 2 in a similar manner as in FIG. 4A. The sheet 1*a* separated and conveyed by the belt 2 is conveyed by the sheet feeding roller pair 9 to the image forming unit 103 through the guide plate pair 10.

It is to be noted that the power supply 4 is not limited to an alternating-current power supply, and may instead be a direct-current voltage alternated between high and low potentials. Further, the waveform of the voltage may be either a rectangular wave or a sine wave. In the present embodiment, the surface of the belt 2 is supplied with a rectangular-wave voltage having an amplitude of approximately 4 kV (kilovolts).

If the sheet feeding device 104 includes a discharging roller electrode, the charge of the charged belt 2 can be removed by an alternating voltage applied to the belt 2 by the discharging roller electrode. Specifically, when the outer circumferential surface of the belt 2 is brought into contact with the discharging roller electrode and supplied with a direct-current voltage by a direct-current power supply, the belt 2 is not charged by the applied direct-current voltage, if the direct-current voltage does not reach a predetermined voltage. The predetermined voltage is referred to as the charge start voltage. The charge start voltage value $V_0$ varies depending on, for example, the thickness and the volume resistivity of the belt 2.

It has been confirmed that, if the discharging roller electrode is supplied with an alternating voltage having the charge start voltage value $V_0$ as the peak value thereof, the surface potential of the charged belt 2 is discharged to substantially 0 V. This indicates that the applied voltage having the charge start voltage value $V_0$ as the peak value thereof is not capable of charging a dielectric object to be charged, but is capable of discharging the object with force for moving the space charge of the object. Further, the applied voltage used here alternates, and thus has the discharging effect whether the dielectric object is positively charged or negatively charged. If the applied voltage does not reach the charge start voltage, however, insufficient discharging is caused. Meanwhile, if the applied voltage exceeds the charge start voltage, charging is caused with an applied frequency of 120 Hz (hertz) and a period (i.e., wavelength=velocity/frequency) of 1 mm, and thus the charge is not discharged to 0 V. It is therefore preferred that the alternating voltage applied to the discharging roller electrode be controlled to have the charge start voltage of the belt 2 as the peak value thereof.

As described above, the sheet feeding device 104 according to the present embodiment includes the bottom plate 7 for carrying thereon the sheet stack 1, and the separation unit 107 for electrostatically attracting the uppermost sheet 1*a* of the sheet stack 1 and separating and conveying the sheet 1*a* from the sheet stack 1. Further, the separation unit 107 is placed between the upstream end and the central position in the sheet conveying direction of the sheet stack 1 located at the sheet carrying position and having the minimum sheet size compatible with the sheet feeding device 104.

The further upstream in the sheet conveying direction of the sheet stack 1 the separation unit 107 is located, the faster the uppermost sheet 1*a* passes under the separation unit 107. With this configuration, therefore, it is possible to promptly bring the separation unit 107 into contact with the second uppermost sheet 1*b*, and thus to extend the attraction time for attracting the second uppermost sheet 1*b*. Thus, even if the sheet stack 1 has the minimum sheet size compatible with the sheet feeding device 104, a relatively long attraction time is secured. Accordingly, the sheet feeding device 104 employing the electrostatic attraction separation method is capable of achieving relatively high productivity irrespective of the characteristics of the sheets.

Further, the sheet feeding device 104 according to the present embodiment includes the sheet feeding roller pair 9 for further conveying the sheet 1*a* separated and conveyed by the separation unit 107, and the bottom plate lifting arms 8 for lifting and lowering the sheet stack 1 carried on the bottom plate 7. Further, the sheet feeding device 104 causes the bottom plate lifting arms 8 to lift the sheet stack 1 to the lift position at which the uppermost sheet 1*a* of the sheet stack 1 contacts the separation unit 107, causes the separation unit 107 to stand by for a predetermined time to attract the uppermost sheet 1*a*, and causes the separation unit 107 to start, after the lapse of the predetermined time, conveying the sheet 1*a* toward the sheet feeding roller pair 9 with the sheet stack 1 kept at the lift position.

In the electrostatic attraction separation method, therefore, the electric field generated by the non-uniform charging of the belt 2 of the separation unit 107 first acts on a plurality of sheets of the sheet stack 1 on the basis of the action of the Maxwell stress, and attraction force for attracting the plurality of sheets is generated. After the lapse of the predetermined time, however, the free electrons in the uppermost sheet 1*a* gather toward the belt 2 to cancel the electric field of the belt 2, and the attraction force of the belt 2 acts only on the uppermost sheet 1*a*. Accordingly, it is possible to drive the separation unit 107 and start conveying the sheet 1*a* without separating the belt 2 from the sheet 1*a* by lifting and lowering the bottom plate 7 or by moving the separation unit 107 up and down.

Further, in the sheet feeding device 104 according to the present embodiment, the separation unit 107 is placed at the center in the direction perpendicular to the sheet conveying direction. With this configuration, when the sheet 1*a* is attracted by the separation unit 107, the sheet 1*a* is prevented from dropped off from the separation unit 107 due to weight imbalance thereof. Further, when the attracted sheet 1*a* is conveyed, the sheet 1*a* is prevented from being skewed due to the imbalance thereof and from being wrinkled due to the skew.

Further, in the sheet feeding device 104 according to the present embodiment, the separation unit 107 includes the upstream roller 6, the downstream roller 5, and the circular belt 2 formed by a dielectric material and stretched over the upstream roller 6 and the downstream roller 5. Further, the upstream roller 6 located upstream in the sheet conveying direction of the downstream roller 5 is driven. With this configuration, when the upstream roller 6 is driven to rotate the belt 2 in the sheet conveying direction, the lower side of the belt 2 slacks. Thus, even if the surface of the sheet 1*a* have irregularities due to, for example, the undulation thereof, it is possible to secure the area of contact between the belt 2 and the sheet 1*a*, and thus to secure the attraction force of the belt 2 for attracting the sheet 1*a*.

Further, the image forming apparatus 101 according to the present embodiment includes the above-described sheet feeding device 104. With this configuration, the image forming apparatus 101 achieves relatively high productivity irrespective of the characteristics of the sheet 1*a*.

Subsequently, a sheet feeding device according to another embodiment of the present invention will be described with reference to FIGS. 6 to 9B. The same components as the components of the foregoing embodiment will be designated by the same reference numerals, and description thereof will be omitted.

Figure 6:
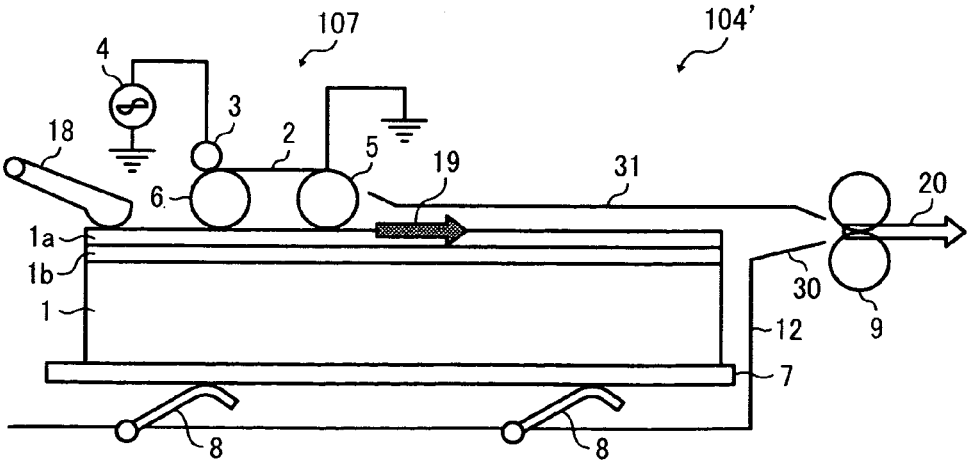
FIG. 6 is a cross-sectional view of a sheet feeding device according to another embodiment of the present invention.

As illustrated in FIG. 6, in a sheet feeding device 104' according to the present embodiment, the belt 2 is placed between the upstream end and the central position in the sheet conveying direction of the sheet stack 1 located at a stand-by position at which the sheet stack 1 is carried on the bottom plate 7 (i.e., the sheet carrying position), and having the minimum sheet size compatible with the sheet feeding device 104'. For example, if the size of the sheet 1*a* compatible with the sheet feeding device 104' ranges from A5 to A3, the belt 2 is arranged such that the downstream end in the sheet conveying direction of the belt 2, which corresponds to the position of contact of the downstream roller 5 with the sheet 1*a*, is located between the center of the length in the sheet conveying direction of the sheet 1*a* having the minimum sheet size A5 (i.e., 210 mm) and the upstream end of the sheet 1*a*, i.e., between a position apart from the leading end of the sheet 1*a* by 105 mm to a position apart from the leading end by 210 mm. Herein, the upstream end in the sheet conveying direction refers to an end portion on the left side in FIG. 6.

On the downstream side in the sheet conveying direction of the belt 2, guide plates 30 and 31 for guiding the conveyance of the sheet 1*a* and the sheet feeding roller pair 9 for conveying the sheet 1*a* entered between the guide plates 30 and 31 are provided.

Further, as illustrated in FIG. 6, in the sheet feeding device 104', a tangent line 19 of a nip portion formed by the lower surface of the belt 2 and the sheet stack 1 (specifically, the sheet 1*a*) and a tangent line 20 of a nip portion formed by the sheet feeding roller pair 9 located downstream in the sheet conveying direction of the belt 2 are arranged on substantially the same line, i.e., the same plane.

With this configuration, the sheet 1*a* conveyed by the rotation of the belt 2 relatively easily enters the nip portion of the sheet feeding roller pair 9. Further, the sheet 1*a* is prevented from being bent. The sheet feeding roller pair 9 formed by two rollers may be replaced by a belt pair, as long as members forming the belt pair form a nip portion. Further, the sheet feeding device 104' may be configured to include pads brought into contact with the rollers or belts.

The guide plate 31 is arranged to be substantially parallel to the tangent lines 19 and 20 of the respective nip portions arranged on substantially the same line. Specifically, the guide plate 31 is arranged above the sheet stack 1 to be substantially parallel to the tangent lines 19 and 20 of the respective nip portions. The clearance between the sheet stack 1 and the guide plate 31 is set to be narrow enough to reliably guide the sheet 1*a* to the sheet feeding roller pair 9, and to be wide enough not to hinder the conveyance of the sheet 1*a* due to the contact between the sheet stack 1 and the guide plate 31. Further, the downstream end in the sheet conveying direction of the guide plate 31 is tilted toward the center of the nip portion of the sheet feeding roller pair 9 to guide the sheet 1*a* to the center of the nip portion. In FIG. 6, the tangent lines 19 and 20 of the respective nip portions are designated by arrows to indicate the conveying direction of the sheet 1*a*. With this configuration, even when conveying the sheet 1*a* deformed by moisture attraction or drying, it is possible to smoothly introduce the downstream end in the sheet conveying direction of the sheet 1*a* into the nip portion of the sheet feeding roller pair 9.

Further, with the guide plate 31 arranged substantially parallel to the tangent lines 19 and 20 of the respective nip portions, the downstream end in the sheet conveying direction of the sheet 1*a* is prevented from being bent.

Meanwhile, the guide plate 30 is placed at a position between the sheet stack 1 and the sheet feeding roller pair 9 and lower than the sheet 1*a*. Further, the guide plate 30 is tilted toward the center of the nip portion of the sheet feeding roller pair 9 to guide the sheet 1*a* to the center of the nip portion.

The guide plates 30 and 31 are desired to have a relatively low coefficient of friction with the sheet 1*a*. Preferably, therefore, the guide plates 30 and 31 are formed by, for example, a base member made of an ABS (acrylonitrile butadiene styrene) resin and having a surface coated with a fluororesin or the like having a relatively low coefficient of friction.

Figure 7A:
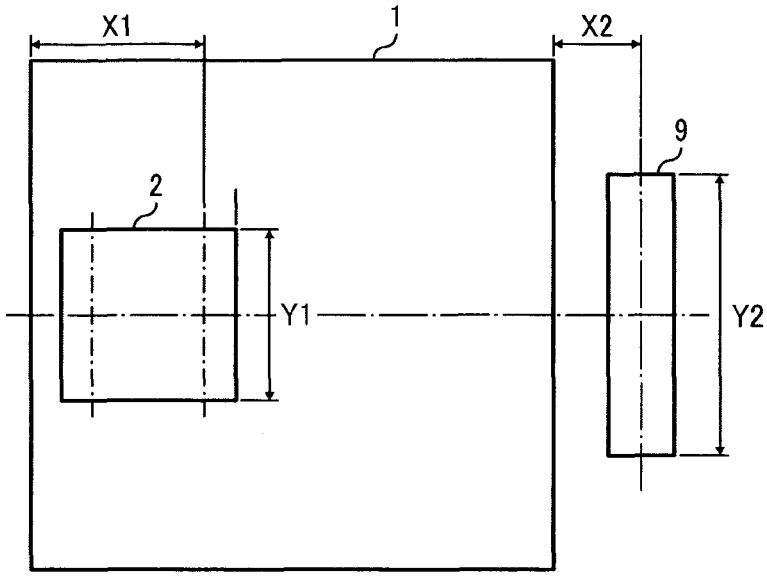
Figure 7B:
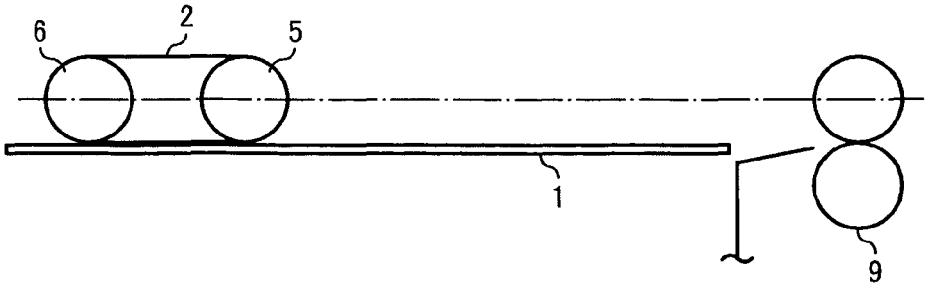

Further, in the sheet feeding device 104', distances X1 and X2 satisfy the relationship X1>X2, as illustrated in FIGS. 7A and 7B. Herein, X1 represents the distance between the upstream end in the sheet conveying direction of the sheet stack 1 in the stand-by state and the nip portion on the downstream side in the sheet conveying direction of the belt 2.

Meanwhile, X2 represents the distance between the downstream end in the sheet conveying direction of the sheet stack 1 in the stand-by state and the nip portion of the sheet feeding roller pair 9.

That is, the distance X1 between the upstream end in the sheet conveying direction of the sheet stack 1 carried on the bottom plate 7 and the nip portion at the downstream end in the sheet conveying direction of the belt 2 and the distance X2 between the downstream end in the sheet conveying direction of the sheet stack 1 carried on the bottom plate 7 and the nip portion of the sheet feeding roller pair 9 satisfy the relationship X1>X2. With this configuration, the sheet 1*a* conveyed by the belt 2 relatively easily enters the nip portion of the sheet feeding roller pair 9, and the distance X1 is reduced. Accordingly, it is possible to reduce the size of the sheet feeding device 104'.

Further, in the sheet feeding device 104', a width Y1 of the belt 2 and a width Y2 of the sheet feeding roller pair 9 have the relationship Y1<Y2, and the sheet feeding roller pair 9 has relatively high surface friction. With this configuration, the conveying force of the sheet feeding roller pair 9 is set to be greater than the conveying force of the belt 2.

In existing sheet feeding devices, if the sheet 1*a* skids on the conveying path between the belt 2 and the sheet feeding roller pair 9, the sheet 1*a* is bent between the belt 2 and the sheet feeding roller pair 9. If the sheet 1*a* enters the nip portion of the sheet feeding roller pair 9 in this state, the sheet 1*a* may be wrinkled. Meanwhile, the above-described configuration of the present embodiment suppresses the bending of the sheet 1*a*, and thus prevents the sheet 1*a* from being wrinkled. Further, with the increase in conveying force of the sheet feeding roller pair 9, it is possible to increase the curvature of the conveying path formed between the belt 2 and the sheet feeding roller pair 9, and thus to increase the degree of design freedom. The sheet feeding roller pair 9 may be divided into a plurality of roller pairs in the width direction thereof, i.e., in the vertical direction in FIG. 7A such that the divided roller pairs can independently rotate.

Figure 8A:
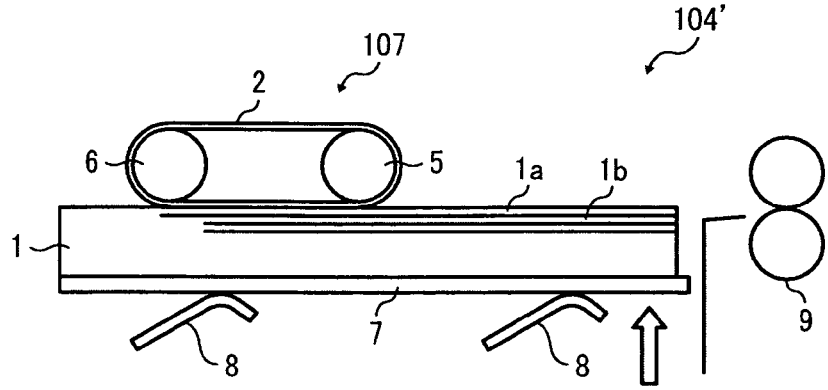
FIGS. 8A, 8B, and 8C are cross-sectional views illustrating operations of the sheet feeding device according to the another embodiment of the present invention.

Subsequently, the operations of the sheet feeding device 104' will be described. As illustrated in FIG. 8A, upon receipt of a sheet feeding command signal from a not-illustrated control unit, the electromagnetic clutch 16 is turned on to drive and rotate the upstream roller 6. Thereby, the belt 2 starts rotating, and is supplied with an alternating voltage by the power supply 4 via the roller electrode 3. Accordingly, the surface of the belt 2 is formed with charge patterns alternating at intervals according to the frequency of the alternating-current power supply and the rotation speed of the belt 2. Preferably, the intervals are set to approximately 4 mm to approximately 16 mm.

After the charging of the belt 2, the bottom plate lifting arms 8 start lifting the lowered bottom plate 7. The bottom plate lifting arms 8 stop lifting the bottom plate 7 when the feeler sensor 18 (see FIG. 6) detects that the uppermost sheet 1*a* of the sheet stack 1 has reached a lift position at which the sheet 1*a* contacts the belt 2. In the lifting of the bottom plate 7, the lift amount of the bottom plate 7 may be determined on the basis of the calculation of the difference in height between the lower surface of the belt 2 and the position of the upper surface of the sheet 1*a* prior to the lifting of the bottom plate 7, which has previously been detected by the feeler sensor 18.

Figure 8B:
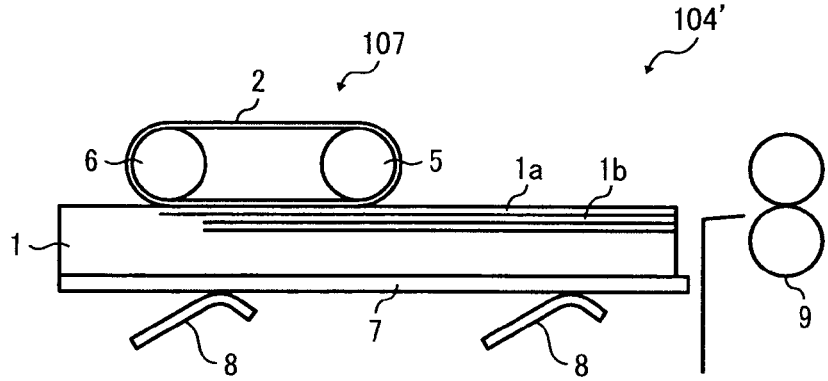

Then, as illustrated in FIG. 8B, in the state in which the belt 2 and the uppermost sheet 1*a* of the sheet stack 1 are in contact with each other, the belt 2 stands by for a predetermined time, which has been preset for each of each type of sheet. Thereby, the Maxwell stress acts on the uppermost sheet 1*a*, which is a dielectric material, due to a non-uniform electric field generated by the charge patterns formed on the surface of the belt 2. As a result, only the uppermost sheet 1*a* is attracted and held by the belt 2.

Immediately after the contact between the belt 2 and the uppermost sheet 1*a*, the electric field generated by the non-uniform charging of the belt 2 acts on a plurality of sheets of the sheet stack 1 on the basis of the action of the Maxwell stress, and attraction force for attracting the plurality of sheets is generated. After the lapse of the predetermined time, however, free electrons in the uppermost sheet 1*a* gather toward the belt 2 to cancel the electric field of the belt 2. Therefore, the attraction force of the belt 2 acts only on the uppermost sheet 1*a*.

Figure 8C:
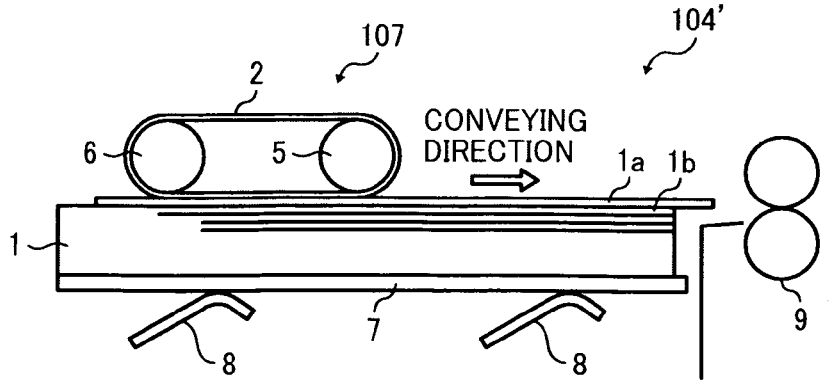

Then, as illustrated in FIG. 8C, the belt 2 rotates and starts conveying the sheet 1*a* in the state in which the sheet stack 1 is kept at the lift position. Then, at a position corresponding to the downstream roller 5, the sheet 1*a* separates from the belt 2 due to the curvature of the downstream roller 5. The conveyance of the sheet 1*a* based on the rotation of the belt 2 does not use the frictional force acting between the belt 2 and the sheet 1*a*, but uses the electrostatic attraction force. It is therefore possible to reduce contact pressure between the belt 2 and the sheet 1*a* to a sufficiently small value. Accordingly, the uppermost sheet 1*a* and the second uppermost sheet 1*b* are prevented from being conveyed together in an overlapped matter due to the frictional force acting therebetween. That is, multiple feeding is prevented. The sheet feeding roller pair 9 and the belt 2 are set to have the same linear velocity. Therefore, if the sheet feeding roller pair 9 is intermittently driven to adjust the timing, the belt 2 is also controlled to be intermittently driven.

Figure 9A:
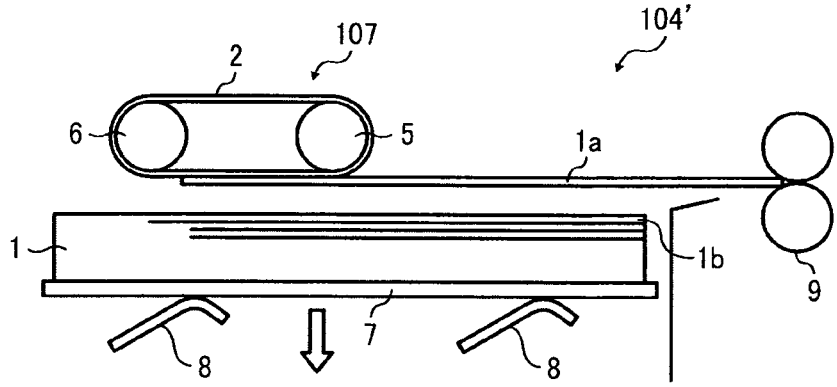
FIGS. 9A and 9B are cross-sectional views illustrating operations subsequent to the operations illustrated in FIGS. 8A, 8B, and 8C.

Then, as illustrated in FIG. 9A, before the upstream end in the sheet conveying direction of the sheet 1*a* reaches a position facing the upstream roller 6, the bottom plate 7 is lowered for a predetermined time to separate the belt 2 from the sheet stack 1. Thereby, the second uppermost sheet 1*b* of the sheet stack 1 is prevented from being attracted by the belt 2 during the conveyance of the uppermost sheet 1*a*. Further, in the state in which the belt 2 and the sheet stack 1 are separated from each other, the belt 2 is charged in preparation for the attraction of the next sheet 1*b*.

Figure 9B:
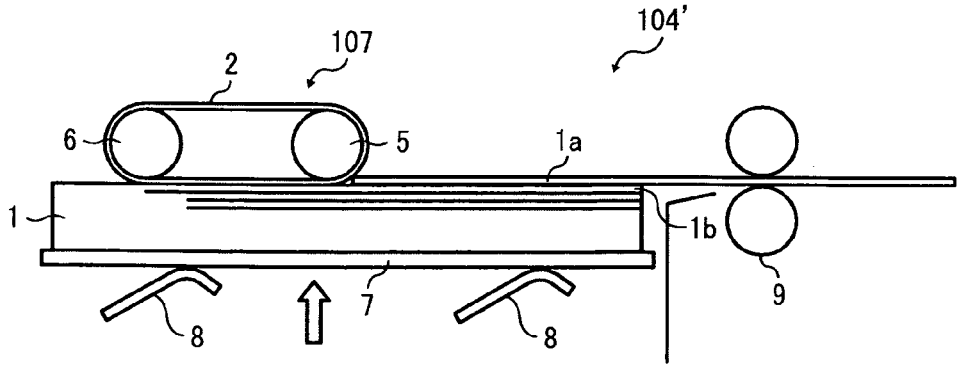

Then, as illustrated in FIG. 9B, the bottom plate 7 is lifted after the upstream end in the sheet conveying direction of the sheet 1*a* has passed a position facing the downstream roller 5. The sheet stack 1 having the sheet 1*b* on the top thereof is then brought into contact with the belt 2 in a similar manner as in FIG. 8A. The sheet 1*a* separated and conveyed by the belt 2 is conveyed by the sheet feeding roller pair 9 to the image forming unit 103 through the conveying path formed by the guide plates 30 and 31.

As described above, the sheet feeding device 104' according to the present embodiment includes the sheet feeding roller pair 9 which nips and further conveys the sheet 1*a* separated and conveyed by the separation unit 107.

Further, in the sheet feeding device 104' according to the present embodiment, the separation unit 107 and the sheet feeding roller pair 9 are arranged such that the tangent line 19 of the nip portion formed by the separation unit 107 and the sheet stack 1 and the tangent line 20 of the nip portion formed by the sheet feeding roller pair 9 are located on substantially the same line.

As described above, the separation unit 107 is placed between the upstream end and the central position in the sheet conveying direction of the sheet stack 1 located at the sheet carrying position and having the minimum sheet size compatible with the sheet feeding device 104'. In this configuration, stable conveying behavior may be prevented in conveying the downstream end in the sheet conveying direction of the sheet 1*a*, i.e., the leading end in the sheet moving direction of the sheet 1*a*. Further, the downstream end in the sheet conveying direction of the sheet 1*a* may be bent by the guide plates 30 and 31 and cause a failure such as sheet jam. According to the above-described configuration, however, the separation unit 107 and the sheet feeding roller pair 9 are arranged such that the tangent line 19 of the nip portion formed by the separation unit 107 and the sheet stack 1 and the tangent line 20 of the nip portion formed by the sheet feeding roller pair 9 are located on substantially the same line. Therefore, the sheet 1*a* relatively easily enters the nip portion of the sheet feeding roller pair 9, and is prevented from being bent in the conveying path. Accordingly, the conveying behavior in conveying the downstream end in the sheet conveying direction of the sheet 1*a* is stabilized, and the downstream end in the sheet conveying direction of the sheet 1*a* is prevented from being bent by the guide plates 30 and 31 and causing a failure such as sheet jam.

Further, in the sheet feeding device 104' according to the present embodiment, the distances X1 and X2 satisfy the relationship X1>X2, wherein X1 represents the distance between the upstream end in the sheet conveying direction of the sheet stack 1 carried on the bottom plate 7 and the nip portion at the downstream end in the sheet conveying direction of the separation unit 107, and X2 represents the distance between the downstream end in the sheet conveying direction of the sheet stack 1 carried on the bottom plate 7 and the nip portion of the sheet feeding roller pair 9. With this configuration, the sheet 1*a* relatively easily the tangent line 19 of the nip portion formed by the separation unit 107 and the sheet stack 1 and the tangent line 20 of the nip portion formed by the sheet feeding roller pair 9 are located on substantially the same line. Therefore, the sheet 1*a* relatively easily enters the nip portion of the sheet feeding roller pair 9, and is prevented from being bent in the conveying path. Accordingly, the conveying behavior in conveying the downstream end in the sheet conveying direction of the sheet 1*a* is stabilized, and the downstream end in the sheet conveying direction of the sheet 1*a* is prevented from being bent by the guide plates 30 and 31 and causing a failure such as sheet jam.

Further, in the sheet feeding device 104' according to the present embodiment, the distances X1 and X2 satisfy the relationship X1>X2, wherein X1 represents the distance between the upstream end in the sheet conveying direction of the sheet stack 1 carried on the bottom plate 7 and the nip portion at the downstream end in the sheet conveying direction of the separation unit 107, and X2 represents the distance between the downstream end in the sheet conveying direction of the sheet stack 1 carried on the bottom plate 7 and the nip portion of the sheet feeding roller pair 9. With this configuration, the sheet 1*a* relatively easily enters the nip portion of the sheet feeding roller pair 9, and the distance X1 is reduced. Accordingly, it is possible to reduce the size of the sheet feeding device 104'.

Further, in the sheet feeding device 104' according to the present embodiment, the planar guide plate 31 is provided which is placed between the separation unit 107 and the sheet feeding roller pair 9 to be substantially parallel to the tangent line 19 of the nip portion formed by the separation unit 107 and the sheet stack 1 and the tangent line 20 of the nip portion formed by the sheet feeding roller pair 9, and which guides the uppermost sheet 1*a* from the separation unit 107 to the sheet feeding roller pair 9. With this configuration, even when conveying the sheet 1*a* deformed by moisture attraction or drying, it is possible to smoothly introduce the downstream end in the sheet conveying direction of the sheet 1*a* into the nip portion of the sheet feeding roller pair 9. Further, the guide plate 31 is a planar member arranged substantially parallel to the tangent line 19 of the nip portion formed by the separation unit 107 and the sheet stack 1 and the tangent line 20 of the nip portion formed by the sheet feeding roller pair 9. Therefore, the downstream end in the sheet conveying direction of the sheet 1*a* is prevented from being bent by the guide plate 31.

Further, in the sheet feeding device 104' according to the present embodiment, the conveying force of the sheet feeding roller pair 9 is set to be greater than the conveying force of the separation unit 107.

In existing sheet feeding devices, if the sheet 1*a* skids on the conveying path between the separation unit 107 and the sheet feeding roller pair 9, the sheet 1*a* is bent between the separation unit 107 and the sheet feeding roller pair 9. If the sheet 1*a* enters the nip portion of the sheet feeding roller pair 9 in this state, the sheet 1*a* may be wrinkled. Meanwhile, in the above-described configuration of the present embodiment, the conveying force of the sheet feeding roller pair 9 is set to be greater than the conveying force of the separation unit 107. Accordingly, it is possible to suppress the bending of the sheet 1*a*, and thus to prevent the sheet 1*a* from being wrinkled. Further, with the increase in conveying force of the sheet feeding roller pair 9, it is possible to increase the curvature of the conveying path formed between the separation unit 107 and the sheet feeding roller pair 9, and thus to increase the degree of design freedom.

Further, an image forming apparatus according to an embodiment of the present invention includes the above-described sheet feeding device 104', the image forming unit 103 which forms an image on the sheet 1*a* fed from the sheet feeding device 104', and the conveying roller pair 108 which conveys the sheet 1*a* to the image forming unit 103. With this configuration, the image forming apparatus achieves relatively high productivity irrespective of the characteristics of the sheet 1*a*.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape, are not limited the embodiments and thus may be preferably set. It is therefore to be understood that within the scope of the appended claims, the disclosure of this patent specification may be practiced otherwise than as specifically described herein.

What is claimed is:

1. A sheet feeding device, comprising:

a sheet carrying unit to carry thereon a sheet stack;

an attraction separation and conveyance device to electrostatically attract an uppermost sheet of the sheet stack and separate and convey the uppermost sheet from the sheet stack, entirely disposed within an upstream end and a central position in a sheet conveying direction of the sheet stack in a state in which the sheet stack is located at a sheet carrying position and having a minimum sheet size compatible with the sheet feeding device; and a sheet conveying device, disposed immediately downstream from the attraction separation and conveyance device in the sheet conveying direction, including a roller pair for nipping and further conveying the uppermost sheet separated and conveyed by the attraction separation and conveyance device;

wherein the sheet conveying device further includes a belt wound around a plurality of rollers, and the plurality of rollers includes a downstream roller and an upstream roller serving as a driven roller and a driven roller, respectively.

2. The sheet feeding device according to claim 1, further comprising:

a lifting and lowering device configured to lift and lower the sheet stack carried on the sheet carrying unit, wherein the sheet feeding device causes the lifting and lowering device to lift the sheet stack to a lift position at which the uppermost sheet contacts with the attraction separation and conveyance device, causes the attraction separation and conveyance device to stand by for a set time to attract the uppermost sheet, and causes the attraction separation and conveyance device to start conveying the uppermost sheet with the sheet stack kept at the lift position after the set time elapses.

3. The sheet feeding device according to claim 1, wherein the attraction separation and conveyance device is centrally disposed in a direction perpendicular to the sheet conveying direction with respect to the sheet carrying unit.

4. The sheet feeding device according to claim 1, wherein the attraction separation and conveyance device includes a plurality of rollers driven by a drive device and an endless dielectric belt stretched over the plurality of rollers, and a further upstream roller of the plurality of rollers in the sheet conveying direction driving the attraction separation and conveyance device.

5. The sheet feeding device according to claim 1, further comprising:

a lifting and lowering device configured to lift and lower the sheet stack carried on the sheet carrying unit, wherein the sheet feeding device causes the lifting and lowering device to lift the sheet stack to a lift position at which the uppermost sheet contacts with the attraction separation and conveyance device.

6. The sheet feeding device according to claim 1, wherein the attraction separation and conveyance device and the sheet conveying device are arranged such that a tangent line of a nip portion formed by the attraction separation and conveyance device and the sheet stack and a tangent line of a nip portion formed by the roller pair of the sheet conveying device are substantially the same.

7. The sheet feeding device according to claim 1, wherein $X1>X2$, where "X1" represents a distance between the upstream end in the sheet conveying direction of the sheet stack carried on the sheet carrying unit and a nip portion at the downstream end in the sheet conveying direction of the attraction separation and conveyance device, and "X2" represents a distance between the downstream end in the sheet conveying direction of the sheet stack carried on the sheet carrying unit and a nip portion of the roller pair of the sheet conveying device.

8. The sheet feeding device according to claim 1, further comprising:

a planar guide member disposed between the attraction separation and conveyance device and the sheet conveying device substantially parallel to a tangent line of a nip portion formed by the attraction separation and conveyance device and the sheet stack and a tangent line of a nip portion formed by the roller pair of the sheet conveying device, and configured to guide the uppermost sheet from the attraction separation and conveyance device to the sheet conveying device.

9. The sheet feeding device according to claim 1, wherein the conveying force of the sheet conveying device is set to be greater than the conveying force of the attraction separation and conveyance device.

10. An image forming apparatus comprising:

a sheet feeding device according to claim 1;

an image forming unit configured to form an image on a sheet fed from the sheet feeding device; and a conveying device configured to convey the sheet to the image forming unit.

11. The sheet feeding device according to claim 1, wherein the sheet feeding device causes the attraction separation and conveyance device to stand by for a set time to attract the uppermost sheet and causes the attraction separation and conveyance device to start conveying the uppermost sheet with the sheet stack kept at the lift position after the set time elapses.

12. The sheet feeding device according to claim 1, wherein the downstream roller and the upstream roller are arranged such that a lower tangent line of the belt formed by the downstream roller and the upstream roller is on a level with an upper surface of the sheet.

13. The sheet feeding device according to claim 1, wherein the belt is stretched over the downstream roller and the upstream roller and slacks downward so as to not cause the upstream roller to spin around without rotating the belt.

14. The sheet feeding device according to claim 1, wherein inside portions of side edges of the belt are provided with ribs, the ribs of the belt engage with respective side surfaces of the downstream roller and the upstream roller.

15. The sheet feeding device according to claim 1, further comprising a feeler sensor on the upstream side of the sheet conveying direction to detect the uppermost sheet of the sheet stack lifted by a bottom plate lifting arm is located at a sheet feed position at which the sheet contacts the belt.

16. The sheet feeding device according to claim 15, wherein the feeler sensor is placed at a position corresponding to an end portion in the width direction of the sheet stack, so as to not come into contact with the belt placed on the upstream side in the sheet conveying direction.

17. The sheet feeding device according to claim 15, wherein after the charging of the belt, the bottom plate lifting arms start lifting a lowered bottom plate, and the bottom plate lifting arms stop lifting the bottom plate when the feeler sensor detects that the uppermost sheet of the sheet stack has reached a lift position at which the sheet contacts the belt.

18. The sheet feeding device according to claim 15, wherein in a state in which the belt and the uppermost sheet of the sheet stack are in contact with each other, the belt stands for a set time so that only the uppermost sheet is attracted and held by the belt.

19. The sheet feeding device according to claim 15, wherein in a state in which before the upstream end in the sheet conveying direction of the sheet reaches the upstream roller, the bottom plate is lowered for a set time to separate the sheet stack from the belt.

20. The sheet feeding device according to claim 15, in a state in which the bottom plate is lifted after the upstream end in the sheet conveying direction of the sheet has passed a position facing the downstream roller, the sheet separated and conveyed by the belt is conveyed by the sheet conveying device to an image forming unit.

* * * * *